United States Patent [19]

Okerblom

[11] 4,050,123

[45] Sept. 27, 1977

[54] BILLFOLD PROTECTIVE DEVICE

[76] Inventor: Charles Lindberg Okerblom, 20 Welch Road, Warwick, R.I. 02889

[21] Appl. No.: 611,637

[22] Filed: Feb. 25, 1976

Related U.S. Application Data

[63] Continuation-in-part of Ser. No. 510,699, Sept. 30, 1974, abandoned.

[51] Int. Cl.[2] ..... A45F 5/02; A45C 13/18

[52] U.S. Cl. ..... 24/3 D; 24/3 H; 150/47

[58] Field of Search ..... 24/3 D, 3 H; 150/47

[56] References Cited

U.S. PATENT DOCUMENTS

| | | | |
|---|---|---|---|
| 1,225,692 | 5/1917 | Willis | 150/47 |
| 1,404,278 | 1/1922 | Davis | 150/47 |
| 2,567,602 | 9/1951 | Higgins | 24/3 D |
| 2,891,592 | 6/1959 | Vaca | 150/47 |
| 3,142,876 | 8/1964 | Roberts | 24/3 H |
| 3,346,030 | 10/1967 | Woolf | 150/47 |
| 3,462,801 | 8/1969 | Bortle | 150/47 |

*Primary Examiner*—Paul R. Gilliam
*Assistant Examiner*—Victor N. Sakran

[57] ABSTRACT

This invention relates to an improved means of protecting credit card cases, wallets, and more specifically, pocketbooks of the billfold type against accidental loss or theft by pickpockets without imposing annoying inconvenience to the user or damage or permanent alteration to the billfold, etc.

5 Claims, 16 Drawing Figures

BILLFOLD PROTECTIVE DEVICE

This application is a Continuation-In-Part of Ser. No. 510,699, filed Sept. 30, 1974, now abandoned.

The object of the invention is to provide a device which when properly installed in the billfold, would include a lateral extension projecting outward and upward and which would hang up in the user's pocket on billfold removal unless said extension is depressed towards the billfold. The depressing action of the extension can be accomplished with one finger of the user's hand as the billfold is withdrawn from the pocket, thereby minimizing inconvenience in manipulation. A pickpocket, unaware of the device would not be able to remove the billfold without detection.

A further object of the invention is to provide a novel safety device for billfolds, etc. which is easily inserted into or removed from the billfold card pocket or the fold of material behind the card pocket or pockets.

Other objects and advantages will be in part evident to those skilled in the art and in part pointed out hereinafter in the following descriptions taken in connection with the accompanying drawings wherein there is shown by way of illustration and not of limitation, some of the more obvious variations of functionally acceptable designs, FIG. 3 showing the preferred embodiment of the invention.

BRIEF DESCRIPTION OF THE DRAWING

FIG. 1 is a perspective view of the protective device 13 being inserted into the pocket 18 behind the normal card pocket 11 of the billfold 10 with the guard 15 projecting outward and back into the paper currency pocket 19.

FIG. 2 is a perspective view of the guard 15 extended outward and upward from the folded billfold 10. This is the attitude when the billfold 10 is slipped into the user's trouser pocket. To remove the billfold 10 from the user's trouser pocket, the billfold 10 is held lightly between the thumb and fingers of the user's hand while the guard 15 is depressed towards the billfold 10 with either the little finger or the first finger. Pressure between the fingers and thumb is then increased to hold the guard 15 in the depressed position while the billfold 10 is withdrawn from the pocket. The billfold 10 will slip easily into the user's pocket without depressing the guard 15.

FIG. 3 is an illustration of the preferred protective device 13 design. The device 13 is made of a single strand of high tensile spring wire bent to form the desired shape of frame 14 and guard 15. The frame 14 provides support in all directions to resist disorientation of the protective device 13 with respect to the billfold 10 when pressure is applied to the guard 15. The frame 14 can be installed within the card pocket 11 of the billfold 10 or into the unused pocket 18 behind said card pocket 11 without any alteration of the billfold 10 to accommodate the protective device 13. The frame 14 is rectangular in shape and of proportions suitable to fit the billfold card pocket 11 and made up of portions 14*a*, 14*b*, 14*c*, and 14*d*. The guard 15 is a continuation of portion 14*d* bent upward diagonally and then back on itself to overlap the frame 14. The overlap is important to prevent possible interference when the guard 15 is depressed toward the billfold 10. The guard is made up of portions 15*a*, 15*b*, 15*c*.

FIG. 4 is an illustration of another variation of the protective device 13 which is similar to the device 13 shown in FIG. 3 except that the guard 15 is a continuation of the nearside portion 14*d* of the frame 14. This design is workable but less desireable than the device 13 shown in FIG. 3 because pressure on the guard 15 significantly increases stress at the intersection of the guard 15 and portion 14*d* and produces undesireable flexure of portion 14*d* which would result in increased wear of surfaces in contact with said portion 14*d*.

FIG. 5 is an illustration of a design variation which is very much like FIG. 3 except that portion 14*b* which is essentially straight in FIG. 3 has given way to an essentially curved shape 14*b* in FIG. 5. The purpose of the curvature is to preclude the possibility of the corners of the frame 14 hanging up on the corners of the billfold 10 fabric partition 12 should the user elect to remove the protective device 13 from the billfold 10 for whatever reason, and thereby prevent such damage as might otherwise result from such action.

FIG. 6 is an illustration of a design similar to FIG. 5 but for which all comments relative to FIG. 4 apply.

FIG. 7 is another variation of the basic protective device 13 design.

FIGS. 8 and 9 are variations of the design described in FIG. 3 in which the shape of the guard 15 has been changed.

FIG. 10 is another variation of the basic protective device 13 design in which the shape of the frame 14 has been changed without impairing the function of providing support for the guard 15 in all directions. This is another design which would tend to prevent damage to the billfold fabric partition 12 much as the design shown in FIG. 5 would do in similar circumstances by preventing the partition 12 from working past the frame 14. The frame consists of portions 14*a*, 14*b*, 14*c*, 14*d*, 14*e*, and 14*f* shaped to conform to the proportions of the billfold card pocket 11 with a configuration similar to the letter "M" with a straight portion across the base of said letter "M." The guard consisting of portions 15*a*, 15*b*, and 15*c* are a continuation of base portion 14*f*.

FIGS. 11 thru 16 illustrate design variations of the guard 15. FIGS. 11 and 16 deviate from the common practice of making the protective device in total from a single strand of wire. Each has a knob of suitable material fitted to the end of the guard extention portion 15*a* and identified as 16 in FIG. 11 and 17 in FIG. 16. Each of these design variations would tend to increase the difficulty of billfold 10 removal from the user's pocket to varying degrees when compared with the preferred overlapping design as shown in FIGS. 3 and 5, etc.

Figure 1:
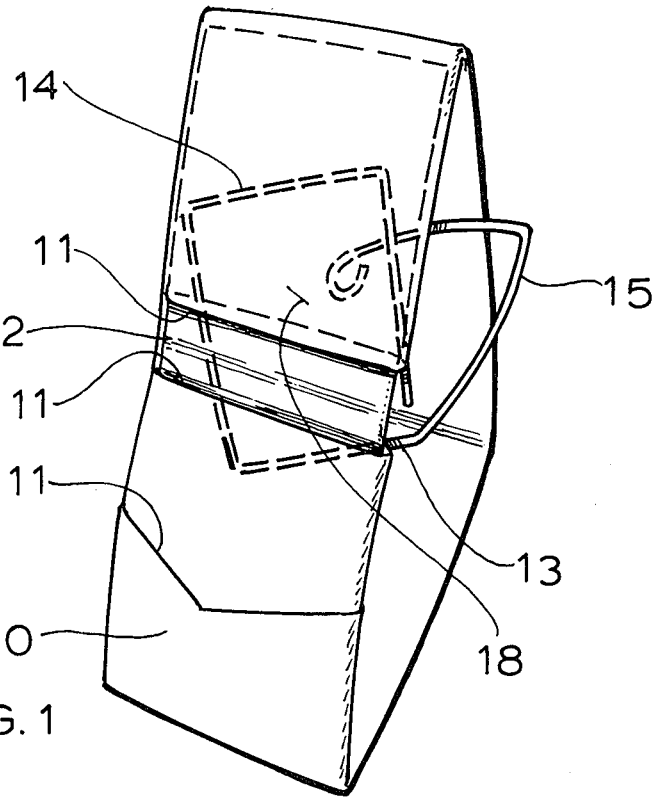
FIGS. 1–16 illustrate various designs and modifications of my billfold protect device.
Figure 2:
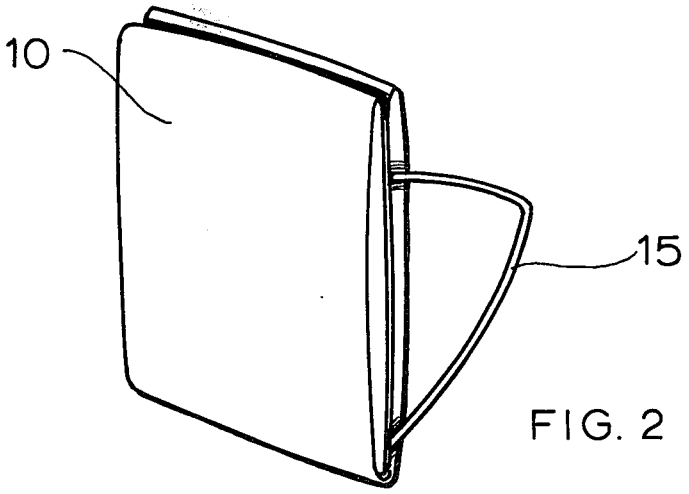
Figure 3:
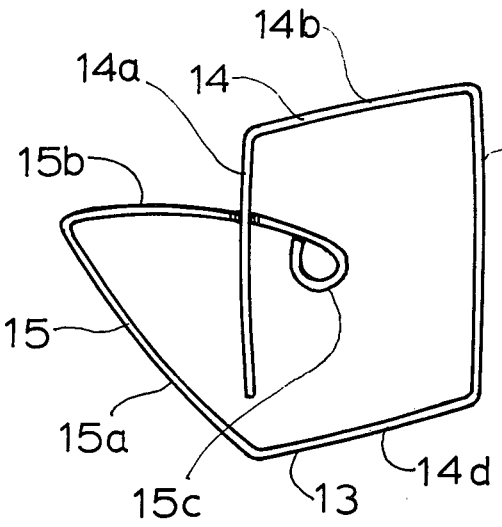
Figure 4:
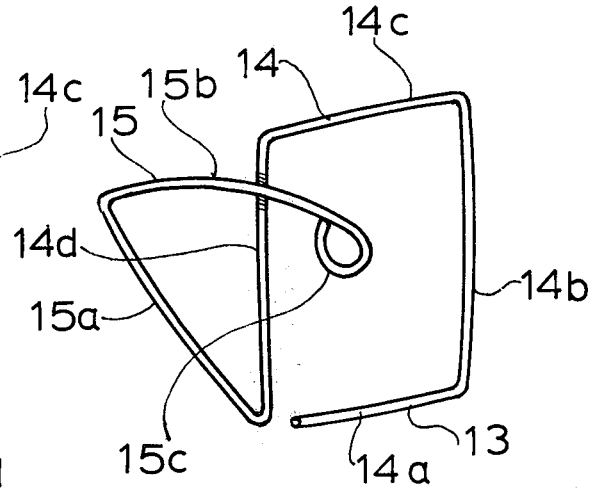
Figure 5:
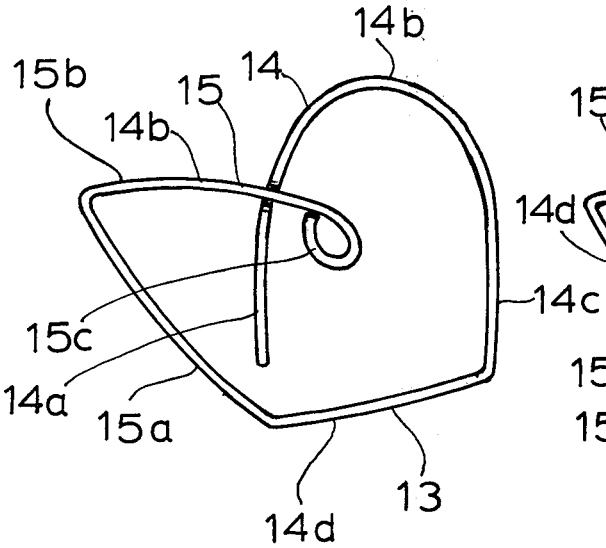
Figure 6:
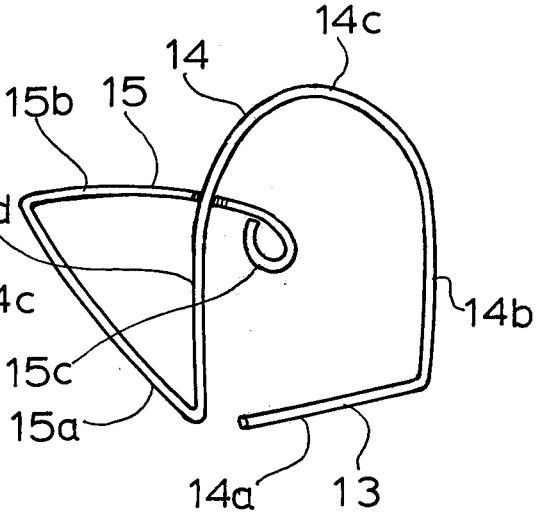
Figure 7:
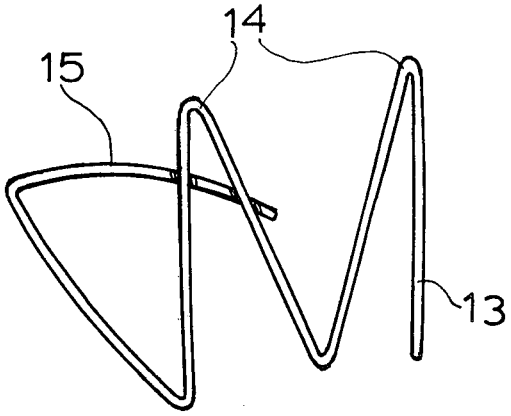
Figure 8:
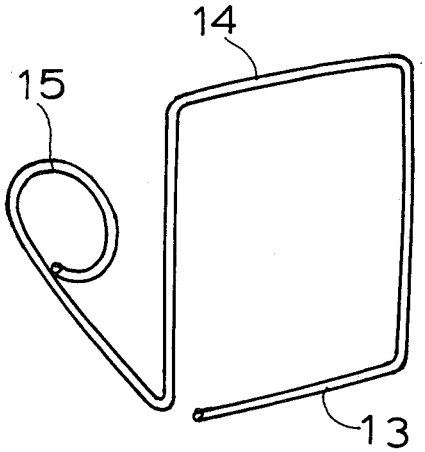
Figure 9:
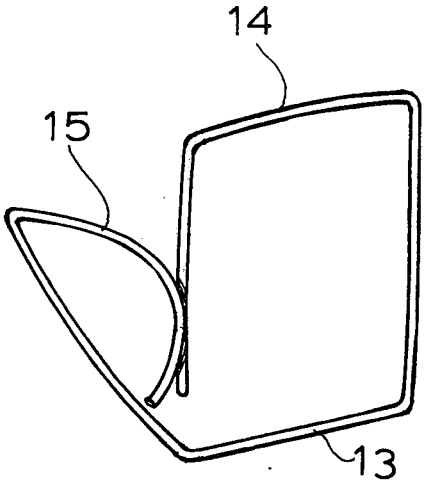
Figure 10:
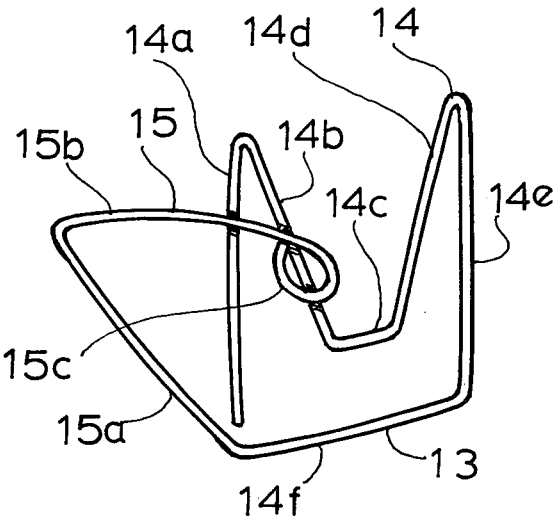
Figure 11:
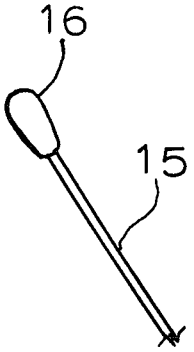
Figure 12:
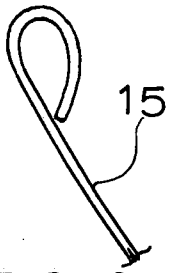
Figure 13:
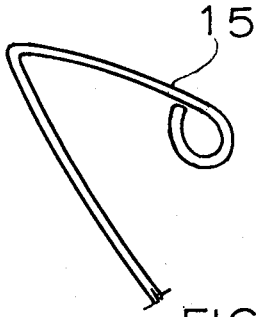
Figure 14:
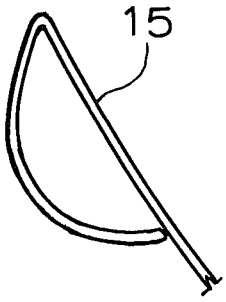
Figure 15:
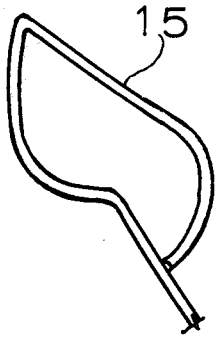
Figure 16:
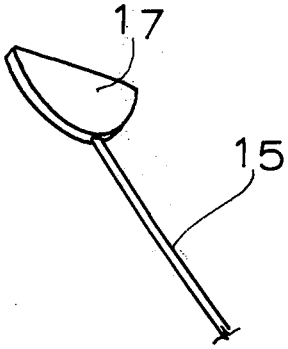

What is claimed as new is as follows:

1. An accidental loss or theft preventing guard which is readily insertable or removable from a card pocket or unused pocket behind said card pocket formed by the center partition and the card pocket material fold of a center folding trouser pocket billfold comprising: a single strand of bendably resilient wire consisting of a straight portion forming one side of a frame, a second portion bent at 90° to form a second side, substantially level, a third portion bent back at 90° to form a third side of the rectangular frame, a fourth portion bent back at 90° to complete the rectangular frame, a fifth portion bent back at approximately 45° and having some curvature such that it is essentially diagonal and then parallel to said frame, and a sixth portion bent back towards said frame and overlapping said frame and ending in a loop.

2. A guard as set forth in claim 1 except that the second portion of the frame has a substantially curved shape to eliminate squared corners at the intersections of portions one and two and two and three.

3. An accidental loss or theft preventing guard which is readily insertable or removable from a card pocket or the unused pocket behind said card pocket formed by the center partition and the card pocket material fold of a center folding trouser pocket billfold comprising: a single strand of bendably resilient wire consisting of a straight portion forming the base of a rectangular frame, a second portion bent at 90° to form the outboard side of said rectangular frame, a third portion, essentially straight and bent at 90° to form the top of the frame, a fourth portion bent at 90° to form the inboard side of said frame, a fifth portion bent back at approximately 135° diagonal to said frame and having some curvature towards said frame, and a sixth portion bent back so as to overlap said frame, and ending in a loop.

4. A guard as set forth in claim 3 except that the third portion of the frame has a substantially curved shape to eliminate squared corners at the intersections of portions two and three and three and four.

5. An accidental loss or theft preventing guard which is readily insertable or removable from a card pocket or the unused pocket behind said card pocket formed by the center partition and the card pocket material fold of a center folding trouser pocket billfold comprising: a single strand of bendably resilient wire consisting of a straight portion forming one side of a frame, a second portion of appropriate length bent back on the first portion approximately 160°, a short third portion bent outward approximately 70°, a fourth portion equal to the second portion in length and bent upwards at approximately 70°, a fifth portion slightly longer than the first portion bent back on the fourth portion at an angle of approximately 160°, a sixth portion equal in length to the distance between the first and fifth portions and bent inward from the fifth portion at 90°, a seventh portion approximately equal in length to the first portion and bent at 45° to the sixth portion and having curvature so as to be first diagnoal and then parallel to the frame formed by portions one thru six, and an eighth portion bent back towards said frame so as to overlap it, and ending in a loop.

* * * * *